United States Patent [19]

Sabol et al.

[11] Patent Number: 4,648,912

[45] Date of Patent: Mar. 10, 1987

[54] HIGH ENERGY BEAM THERMAL PROCESSING OF ALPHA ZIRCONIUM ALLOYS AND THE RESULTING ARTICLES

[75] Inventors: George P. Sabol, Murrysville; Samuel G. McDonald, Monroeville; John I. Nurminen, Acme, all of Pa.

[73] Assignee: Westinghouse Electric Corp., Pittsburgh, Pa.

[21] Appl. No.: 571,123

[22] Filed: Jan. 13, 1984

Related U.S. Application Data

[63] Continuation of Ser. No. 343,788, Jan. 29, 1982, abandoned.

[51] Int. Cl.[4] ..... C22F 1/18

[52] U.S. Cl. ..... 148/11.5 F; 148/133

[58] Field of Search ..... 148/11.5 F, 12.7 B, 148/133

[56] References Cited

U.S. PATENT DOCUMENTS

| | | | |
|---|---|---|---|
| 3,689,324 | 9/1972 | Wiener et al. | 148/11.5 F |
| 3,690,850 | 9/1972 | Edstrom et al. | 428/611 |
| 3,865,635 | 2/1975 | Hofuenstan et al. | 148/11.5 F |
| 4,238,251 | 12/1980 | Williams et al. | 148/133 |
| 4,279,667 | 7/1981 | Anthony et al. | 148/39 |
| 4,360,389 | 11/1982 | Urguhart | 148/11.5 F |
| 4,450,016 | 5/1984 | Vesterlund et al. | 148/11.5 F |
| 4,450,020 | 5/1984 | Vesterlund | 148/11.5 F |

FOREIGN PATENT DOCUMENTS

| | | | |
|---|---|---|---|
| 1537930 | 1/1979 | United Kingdom . | |
| 2041973 | 9/1980 | United Kingdom | 148/133 |

OTHER PUBLICATIONS

Hunt et al., "Recrystallization of Zircaloy-4 During Transient Heating", Journal of Nuclear Materials, vol. 92, Sept. 1980, pp. 184-190.

Andersson et al., "Beta Quenching of Zircaloy Cladding Tubes in Intermediate or Final Size-Methods to Improve Corrosion and Mechanical Properties", Conf. on Zirconium in the Nuclear Industry Boston, Mass., Aug. 4-7, 1980, pp. 1-31.

Snow et al., "Microstructural Transformations by the Laserglaze TM Process in Zircaloy-4 Sheet", Conference on Applications of Lasers in Materials Processing, Apr. 18-20, 1979, Washington, D.C., pp. 229-243.

T. Andersson et al., "Beta Quenching of Zircaloy Cladding Tubes in Intermediate or Final Size-Methods to Improve Corrosion and Mechanical Properties" ASTM Conf., Boston, Mass., Aug. 4-7, 1980.

Urquhart et al., "A Mechanism for the Effect of Heat Treatment on the Accelerated Corrosion of Zircaloy-4 in High Temperature, High Pressure Steam", Journal of Electrochemical Society, Feb. 1978, pp. 199-204.

Urquhart et al., "A Preliminary Correlation Between the Accelerated Corrosion of Zircaloy in BWR's and in High Temperature, High Pressure Steam", Journal of Nuclear Materials, vol. 62, (1976), pp. 111-114.

Vesterlund et al., "Corrosion-Resistant BWR Zircaloy-4 Channels", Transactions of the American Nuclear Society, vol. 34 (1980), pp. 237, 238.

*Primary Examiner*—Christopher W. Brody
*Attorney, Agent, or Firm*—R. A. Stoltz

[57] ABSTRACT

Described herein are alpha zirconium alloy fabrication methods and resultant products exhibiting improved high temperature, high pressure steam corrosion resistance. The process, according to one aspect of this invention, utilizes a high energy beam thermal treatment to provide a layer of beta treated microstructure on an alpha zirconium alloy intermediate product. The treated product is then alpha worked to final size. According to another aspect of the invention, high energy beam thermal treatment is used to produce an alpha annealed microstructure in a Zircaloy alloy intermediate size or final size component. The resultant products are suitable for use in pressurized water and boiling water reactors.

20 Claims, 7 Drawing Figures

TREATED FIRST LAYER

RECRYSTALLIZED SECOND LAYER

HIGH ENERGY BEAM THERMAL PROCESSING OF ALPHA ZIRCONIUM ALLOYS AND THE RESULTING ARTICLES

This application is a continuation of application Ser. No. 343,788, filed Jan. 29, 1982 now abandoned.

CROSS-REFERENCE TO RELATED APPLICATION

Zircaloy alloy fabrication methods and resultant products which also exhibit improved high temperature, high pressure steam corrosion resistance are described in related application Ser. No. 343,787 filed on Jan. 29, 1982 now abandoned, assigned to the same assignee. This related application describes a process in which a conventional beta treatment is followed by reduced temperature alpha working and annealing to provide an alpha worked product having reduced precipitate size, as well as enhanced high temperature, high pressure steam corrosion resistance. Application Ser. No. 343,787 now abandoned is hereby incorporated by reference.

BACKGROUND OF THE INVENTION

The present invention relates to alpha zirconium alloy intermediate and final products, and processes for their fabrication. More particularly, this invention is especially concerned with Zircaloy alloys having a particular microstructure, and the method of producing this microstructure through the use of high energy beam heat treatments, such that the material has improved long term corrosion resistance in a high temperature steam environment.

The Zircaloy alloys were initially developed as cladding materials for nuclear components used within a high temperature pressurized water reactor environment (U.S. Pat. No. 2,772,964). A Zircaloy-2 alloy is an alloy of zirconium comprising about 1.2 to 1.7 weight percent tin, about 0.07 to 0.20 weight percent iron, about 0.05 to 0.15 weight percent chromium, and about 0.03 to 0.08 weight percent nickel. A Zircaloy-4 alloy is an alloy of zirconium comprising about 1.2 to 1.7 weight percent tin, about 0.12 to 0.18 weight percent iron, and about 0.05 to 0.15 weight percent chromium (see U.S. Pat. No. 3,148,055).

In addition variations upon these alloys have been made by varying the above listed alloying elements and/or the addition of amounts of other elements. For example, in some cases it may be desirable to add silicon to the Zircaloy-2 alloy composition as taught in U.S. Pat. No. 3,097,094. In addition oxygen is sometimes considered as an alloying element rather than an impurity, since it is a solid solution strengthener of zirconium.

Nuclear grade Zircaloy-2 or Zircaloy-4 alloys are made by repeated vacuum consumable electrode melting to produce a final ingot having a diameter typically between about 16 and 25 inches. The ingot is then conditioned to remove surface contamination, heated into the beta, alpha+beta phase or high temperature alpha phase and then worked to some intermediate sized and shaped billet. This primary ingot breakdown may be performed by forging, rolling, extruding or combinations of these methods. The intermediate billet is then beta solution treated by heating above the alpha+beta/beta transus temperature and then held in the beta phase for a specified period of time and then quenched in water. After this step it is further thermomechanically worked to a final desired shape at a temperature typically below the alpha/alpha+beta transus temperature.

For Zircaloy alloy material that is to be used as tubular cladding for fuel pellets, the intermediate billet may be beta treated by heating to approximately 1050° C. and subsequently water quenched to a temperature below the alpha+beta to alpha transus temperature. This beta treatment serves to improve the chemical homogeneity of the billet and also produces a more isotropic texture in the material.

Depending upon the size and shape of the intermediate product at this stage of fabrication, the billet may first be alpha worked by heating it to about 750° C. and then forging the hot billet to a size and shape appropriate for extrusion. Once it has attained the desired size and shape (substantially round cross-section), the billet is prepared for extrusion. This preparation includes drilling an axial hole along the center line of the billet, machining the outside diameter to desired dimensions, and applying a suitable lubricant to the surfaces of the billet. The billet diameter is then reduced by extrusion through a frustoconical die and over a mandrel at a temperature of about 700° C. or greater. The asextruded cylinder may then be optionally annealed at about 700° C. Before leaving the primary fabricator, the extruded billet may be cold worked by pilgering to further reduce its wall thickness and outside diameter. At this stage the intermediate product is known as a TREX (Tube Reduced Extrusion). The extrusion or TREX may then be sent to a tube mill for fabrication into the final product.

At the tube mill the extrusion or TREX goes through several cold pilger steps with anneals at about 675°–700° between each reduction step. After the final cold pilger step the material is given a final anneal which may be a full recrystallization anneal, partial recrystallization anneal, or stress relief anneal. The anneal may be performed at a temperature as high as 675°–700° C. Other tube forming methods such as sinking, rocking and drawing, may also completely or partially substitute for the pilgering method.

Thin-walled members of Zircaloy-2 and Zircaloy-4 alloys, such as nuclear fuel cladding, processed by the above-described conventional techniques, have a resultant structure which is essentially single phase alpha with intermetallic particles (i.e. precipitates) containing Zr, Fe, and Cr, and including Ni in the Zircaloy-2 alloy. The precipitates for the most part are randomly distributed, through the alpha phase matrix, but bands or "stringers" of precipitates are frequently observed. The larger precipitates are approximately 1 micron in diameter and the average particle size is approximately 0.3 microns (3000 angstroms) in diameter.

In addition, these members exhibit a strong anisotropy in their crystallographic texture which tends to preferentially align hydrides produced during exposure to high temperature and pressure steam in a circumferential direction in the alpha matrix and helps to provide the required creep and tensile properties in the circumferential direction.

The alpha matrix itself may be characterized by a heavily cold worked or dislocated structure, a partially recrystallized structure or a fully recrystallized structure, depending upon the type of final anneal given the material.

Where final material of a rectangular cross section is desired, the intermediate billet may be processed substantially as described above, with the exception that the reductions after the beta solution treating process are typically performed by hot, warm and/or cold rolling the material at a temperature within the alpha phase or just above the alpha to alpha plus beta transus temperature. Alpha phase hot forging may also be performed. Examples of such processing techniques are described in U.S. Pat. No. 3,645,800.

It has been reported that various properties of Zircaloy alloy components can be improved if beta treating is performed on the final size product or near final size product, in addition to the conventional beta treatment that occurs early in the processing. Examples of such reports are as follows: U.S. Pat. No. 3,865,635, U.S. Pat. No. 4,238,251 and U.S. Pat. No. 4,279,667. Included among these reports is the report that good Zircaloy-4 alloy corrosion properties in high temperature steam environments can be achieved by retention of at least a substantial portion of the precipitate distribution in two dimensional arrays, especially in the alpha phase grain boundaries of the beta treated microstructure. This configuration of precipitates is quite distinct from the substantially random array of precipitates normally observed in alpha worked (i.e. below approximately 1450° F.) Zircaloy alloy final product where the beta treatment, if any, occurred much earlier in the breakdown of the ingot as described above. The extensive alpha working of the material after the usual beta treatment serves to break up the two dimensional arrays of precipitates and distribute them in the random fashion typically observed in alpha-worked final product.

It has been found that conventionally processed, alpha worked Zircaloy alloy cladding (tubing) and channels (plate) when exposed to high temperature steam such as that found in a BWR (Boiling Water Reactor) or about 450° to 500° C., 1500 psi steam autoclave test have a propensity to form thick oxide films with white nodules of spalling corrosion product, rather than the desirable thin continuous, and adherent substantially black corrosion product needed for long term reactor operation.

Where beta treating is performed on the final product in accordance with U.S. Pat. No. 4,238,251 or U.S. Pat. No. 4,279,667, the crystallographic anisotropy of the alpha worked material so treated tends to be dimensioned and results in a higher proportion of the hydrides formed in the material during exposure to high temperature, high pressure aqueous environments being aligned substantially parallel to the radial or thickness direction of the material. Hydrides aligned in this direction can act as stress raisers and adversely affect the mechanical performance of the component.

In addition the high temperatures utilized during a beta treatment process, especially such as that described in U.S. Pat. No. 4,238,251, can create significant thermal distortion or warpage in the component. This is especially true for very thin cross-section components, such as fuel clad tubing.

Through the wall beta treating the component, before the last cold reduction step, as described in U.S. Pat. No. 3,865,635, may result in increased difficulty in meeting texture-related properties in the final product since only a limited amount of alpha working can be provided in the last reduction step.

BRIEF SUMMARY OF THE INVENTION

In accordance with one aspect of the present invention it has been found that the high temperature steam corrosion resistance of an alpha zirconium alloy body can be significantly improved by rapidly scanning the surface of the body with a high energy beam so as to cause at least partial recrystallization or partial dissolution of at least a portion of the precipitates.

Preferably the high energy beam employed is a laser beam and the alloys treated are selected from the groups of Zircaloy-2 alloys, Zircaloy-4 alloys and zirconium-niobium alloys. These materials are preferably in a cold worked condition at the time of treatment by the high energy beam and may also be further cold worked subsequently.

In accordance with the present invention intermediate as well as final products having the microstructures resulting from the above high energy beam rapid scanning treatments are also a subject of the present invention and include, cylindrical, tubular, and rectangular cross-section material.

In accordance with a second aspect of the present invention the high temperature, high pressure steam corrosion resistance of an alpha zirconium alloy body can also be improved by beta treating a first layer of the body which is beneath and adjacent to a first surface of said body so as to produce a Widmanstätten grain structure with two dimensional linear arrays of precipitates at the platelet boundaries in this first layer, while also forming a second layer containing alpha recrystallized grains beneath the first layer. The material so treated is then cold worked in one or more steps to final size, with intermediate alpha anneals between cold working steps.

Preferably any intermediate alpha or final alpha anneals performed after high energy beam beta treatment are performed at a temperature below approximately 600° C. to minimize precipitate coarsening. It has been found that Zircaloy bodies surface beta treated in accordance with this aspect of the invention are easily cold worked. It has also been found that typically both the alpha recrystallized layer as well as the beta treated layer when processed in accordance with the present invention possess good high temperature, high pressure steam corrosion resistance.

Preferably the beta treating is performed by a rapidly scanning high energy beam such as a laser beam. In one embodiment of this aspect of the invention, the degree of cold working after beta treating may be sufficient to redistribute the two dimensional linear arrays of precipitates in a substantially random manner while retaining good high temperature, high pressure steam corrosion resistance.

Beta treated and one-step cold worked alpha zirconium bodies in accordance with this second aspect of the invention are characterized by two microstructural layers. Both layers have anisotropic crystallographic textures; however, it is believed that the outermost layer, that is, the layer that received the beta treatment, is less anisotropic than the inner layer. This difference, however, diminishes as the number of cold working steps and intermediate anneals after beta treating increases.

These and other aspects of the present invention will become more apparent upon review of the drawings in conjunction with the detailed description of the invention.

DESCRIPTION OF THE PREFERRED EMBODIMENT

In one embodiment of the present invention it was found that scanning of final size Zircaloy-4 tubing by a high power laser beam would provide high temperature, high pressure steam corrosion resistance even though a Widmanstätten basket-weave microstructure was not achieved. It was found that material processed as described in the following examples could achieve high temperature, high pressure steam corrosion resistance even though optical metallographic examination of the material revealed it to have partially or fully recrystallized microstructural regions with a substantially uniform precipitate distribution typical of that observed in conventionally alpha worked and annealed Zircaloy tubing.

The laser treatments utilized in this illustration of the present invention are shown in Table I. In all cases a 10.6μ wavelength, 5 kilowatt laser beam was rastered over an area of 0.2 in.×0.4 in. (0.508 cm×1.08 cm) of conventionally fabricated, stress relief annealed, final size Zircaloy-4 tubing, the tubing having a mechanically polished (400–600 grit) outer surface, was simultaneously rotated and translated through the beam area under the conditions shown in Table I. As the tube rotation and tube withdrawal rates decreased, more energy was transmitted to the specimen surface and higher temperatures were attained. This relationship of tube speed to energy is illustrated by the increase in specific surface energy (that is energy striking a square centimeter of the tube surface) with decreasing tube rotation and tube withdrawal rates as shown in Table I. Although the treatment chamber was purged with argon at a rate of about 150 cubic feet/hour, most tubes were covered with a very light oxide coating upon exit from the chamber.

Figure 2:
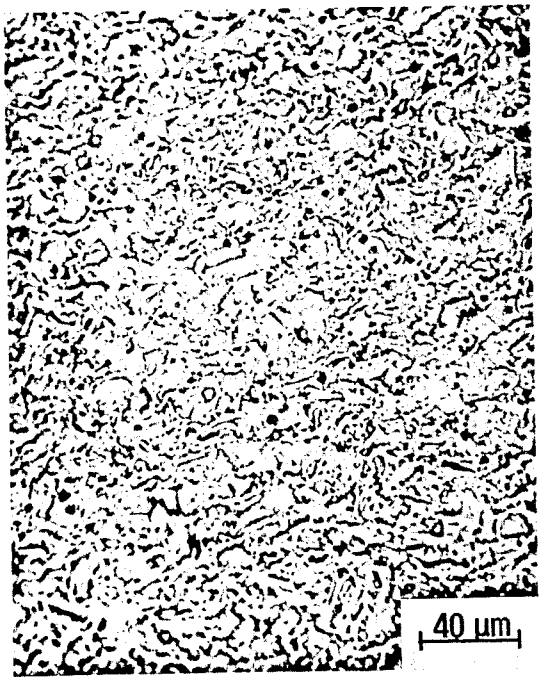
FIGS. 1 and 2 show optical micrographs of microstructures produced by laser treating Zircaloy-4 tubing in accordance with one embodiment of the present invention.
Figure 1:
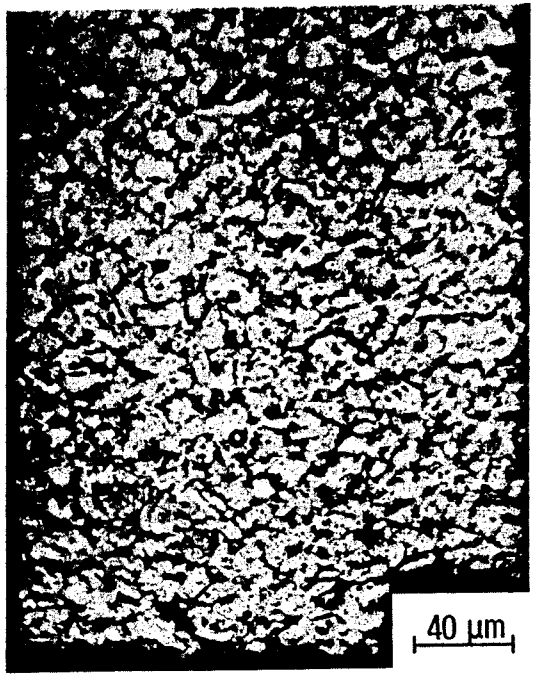
Figure 3B:
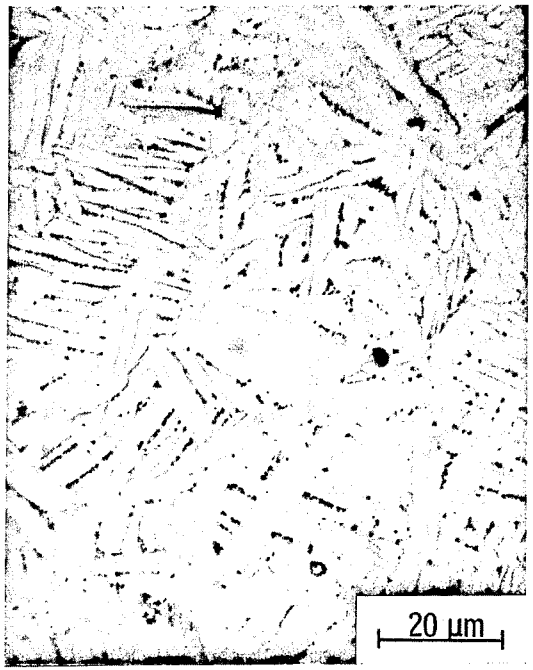
FIGS. 3A and 3B show optical micrographs of a Widmanstätten basket-weave structure produced by laser treating Zircaloy-4 tubing.
Figure 3A:
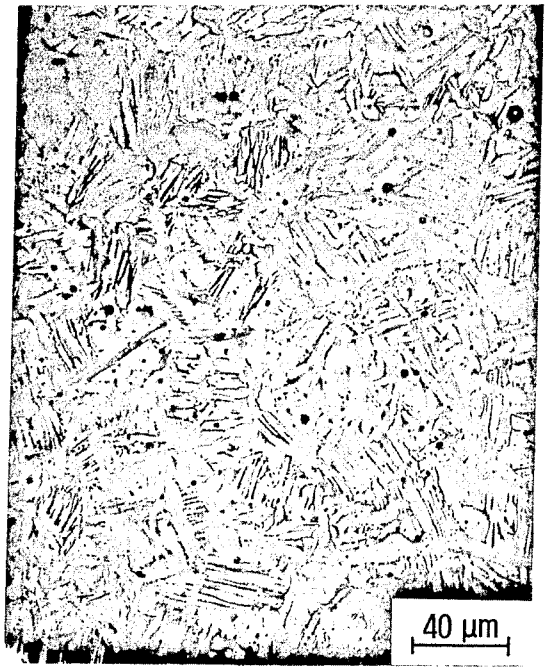

Representative sections of each treatment condition were metallographically polished to identify any microstructural changes that had occurred. Results obtained from optical metallography are listed in Table II, where it can be seen that no obvious microstructural effects were discerned until the rotation speed had been reduced to below 285 rpm, at which recrystallization occurred (241 rpm). At the next slowest speed (196 rpm) the whole tube was transformed to a Widmanstätten basket-weave structure, FIG. 3. Similar Widmanstätten structures were also observed at a rotation speed of 147 rpm. The structures produced at rotation speeds of 241 rpm and 285 rpm are shown in FIGS. 1 and 2, respectively. The only visible difference between the structures was that the 241 rpm sample had a fine recrystallized grain structure, whereas, the 285 rpm sample did not. Faster rotation speeds resulted in structures which were optically indistinguishable from the 285 rpm sample. In no case was a beta treated structure produced solely in an outer layer of the tubing. Both the 196 rpm sample, as well as the 147 rpm sample, had Widmanstätten basket-weave structures (FIGS. 3A and 3B) extending through the wall thickness. Microhardness measurements performed on these specimens indicated that significant softening occurred only in samples where the rotation speed was less than 241 rpm.

Sections of the laser treated tubing were pickled in 45% $H_2O$, 45% $HNO_3$ and 10% HF to remove the oxide that had formed during the processing, and were subsequently corrosion tested in 454° C. (850° F.), 1500 psi steam to determine the effect of the various treatments on high temperature corrosion resistance. After five days corrosion exposure, all samples that had experienced rotation rates greater than 285 rpm had disintegrated, while those with comparable or slower rotation rates had black shiny oxide films. A summary of the corrosion data obtained after 30 days exposure in 454° C. steam is presented in Table III, as are data obtained on beta-annealed+water quenched Zircaloy-4 control coupons which were included in the exposures. It can be seen that the laser treated tubing generally had lower weight gains than the beta treated Zircaloy-4 control coupons. For comparison, conventionally processed cladding disintegrates after 5–10 days in the corrosion environment utilized.

Figure 4B:
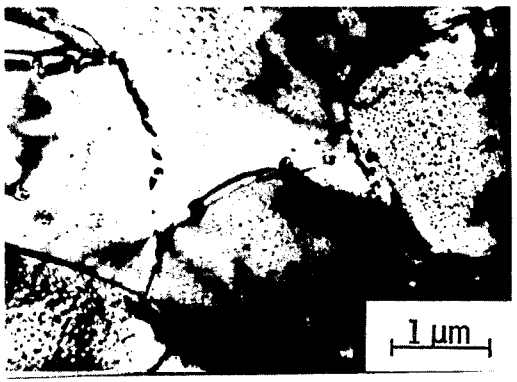
FIGS. 4A and 4B show transmission electron micrographs of typical microstructures found in the embodiment shown in FIGS. 1 and 2.
Figure 4A:
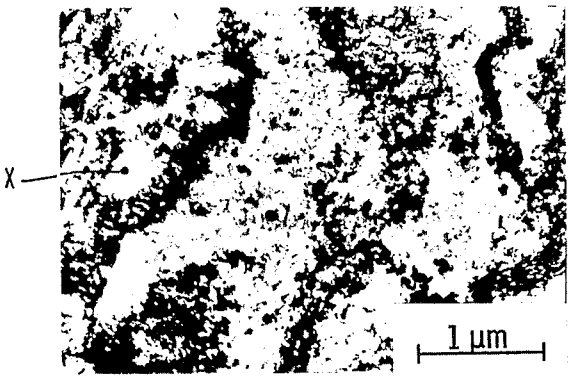

Because beta-treated Zircaloy-4 with a Widmanstätten microstructure has good corrosion resistance in 454° C. steam, it was anticipated, on the basis of optical metallography, that the laser treated specimens with the Widmanstätten structure (FIG. 3) would also have good corrosion resistance. However, the change from catastrophic corrosion behavior to excellent corrosion behavior that occurred between rotation rates of 332 rpm and 285 rpm was not expected on the basis of optical metallography and forms the basis of this embodiment of the present invention. In order to determine what specific microstructural changes were responsible for this phenomena, transmission electron microscopy (TEM) samples were prepared from the 332–241 rpm tubing. The structures that are characteristic of these specimens are shown in FIGS. 4A and 4B. (The dark particles shown in these micrographs are not indigenous precipitates, but are oxides and hydride artifacts introduced during TEM specimen preparation.) All of the samples had areas which were well polygonized (FIG. 4A, area X) and/or recrystallized (FIG. 4B). The structures were quite similar, in overall appearance, to cold-worked Zircaloy-4 that had been subjected to a relatively severe stress relief anneal. Precipitate structures were typical of those in normally processed Zircaloy-4 tubing, although many precipitates were more electron transparent than normally expected, indicating that partial dissolution may have occurred. No qualitatively discernible difference between the specimens which had poor corrosion resistance and good corrosion resistance was noted. It is however theorized that dissolution of intermetallic compounds may result in enrichment of the matrix in Fe and/or Cr, thereby leading to the improved corrosion resistance observed.

In accordance with the present invention the above examples clearly illustrate that laser treating of Zircaloy-4 tubing so as to provide an incident specific surface energy at the treated surface of between approximately 288 and 488 joules per centimeter squared can produce Zircaloy-4 material which forms a thin, adherent and continuous oxide film upon exposure to high temperature and high pressure steam. Based on these corrosion test results it is believed that Zircaloy-4 material so treated will possess good corrosion resistance in boiling water reactor and pressurized water reactor environments.

While these materials in accordance with this invention possess the corrosion resistance of Zircaloy-4 having a Widmanstätten structure, it advantageously is believed to substantially retain the anisotropic texture produced in the alpha working of the material prior to laser treating, making it less susceptible to formation of hydrides in undesirable orientation with respect to the stresses seen by the component during service.

While the invention has been demonstrated using a laser beam, other high energy beams and methods of rapid heating and cooling may also be suitable. The heat up time to the elevated temperature for the above described rapid alpha-annealing treatments was about one third of a second or less (as calculated by dividing the major beam dimension by the tube translation speed, e.g. 0.4 inch/72 inches/minute=0.33 seconds, see tables I and II). Upon leaving the beam the Zircaloy immediately began to cool.

The values of specific surface energy cited above in accordance with the invention may of course vary with the material composition and factors, such as section thickness and material surface condition and shape, which may affect the fraction of the incident specific surface energy absorbed by the component.

It is also believed that the subject treatments are also applicable to other alpha zirconium alloys such as Zircaloy-2 alloys and zirconium-niobium alloys. It is also believed that the excellent corrosion resistance obtained by the described high energy beam heat treatment can be retained after further cold working and low temperature annealing of the material.

The material to be treated may be in a cold worked (with or without a stress relief anneal) or in a recrystallized condition prior to laser treatment.

Figure 5:
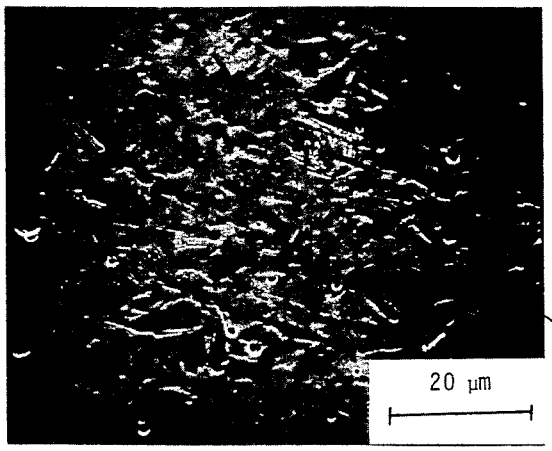
FIG. 5 shows optical and scanning electron microscope micrographs of typical microstructures present in the as-laser treated tube according to the present invention.
Figure 5:
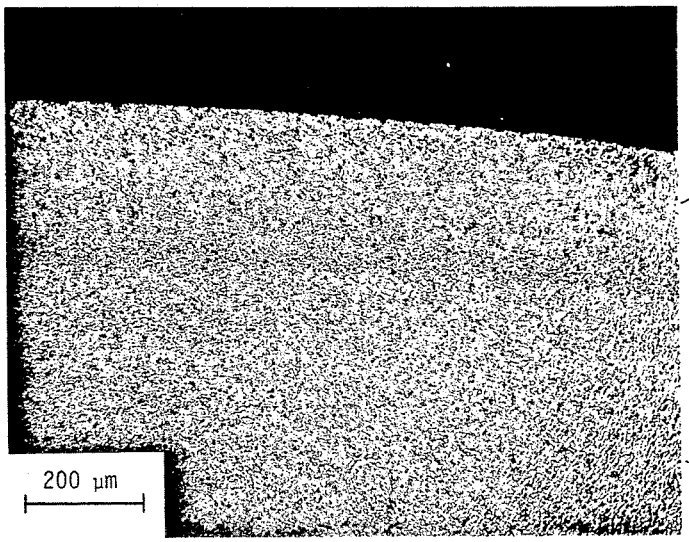
Figure 5:
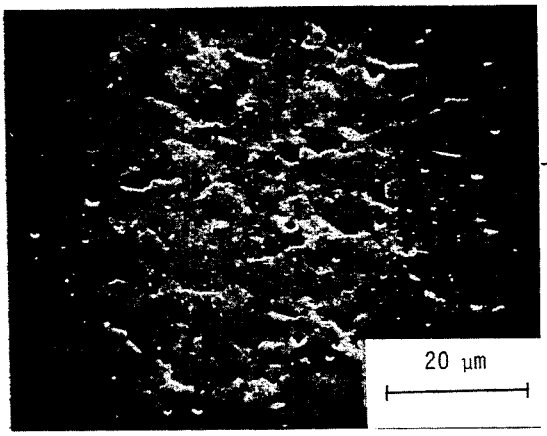

In other embodiments of the present invention conventionally processed Zircaloy-2 and Zircaloy-4 tubes are scanned with a high energy laser beam which beta treats a first layer of tube material beneath and adjacent to the outer circumferential surface, producing a Widmanstätten grain and precipitate morphology in this layer while forming a second layer of alpha recrystallized material beneath this first layer (see FIG. 5). The treated tubes are then cold worked to final size and have been found to have excellent high temperature, high pressure steam corrosion resistance. The following examples are provided to more fully illustrate the processes and products in accordance with these embodiments of the present invention.

Note, as used in this application, the term scanning refers to relative motion between the beam and the workpiece, and either the beam or the workpiece may be actually moving. In all the examples the workpiece is moved past a stationary beam.

The laser surface treatments utilized in these illustrations of the present invention are shown in Table IV. In all cases a continuous wave $CO_2$ laser emitting a 10.6μ wavelength, 12 kilowatt laser beam was utilized. An annular beam was substantially focused onto the outer diameter surface of the tubing and irradiated an arc encompassing about 330° of the tube circumference. The focused arc had a diameter equal to the tube diameter and a length of 0.1 inch. The materials were scanned by the laser by moving the tubes through the ring-like beam. While being treated in a chamber continually being purged with argon, the tubes were rotated at a speed of approximately 1500 revolutions per minute while also being translated at the various speeds shown in inches per minute (IPM) in Table IV, so as to attain laser scanning of the entire tube O.D. surface. The variation in translation speeds or withdrawal or scanning speeds were used to provide the various levels of incident specific surface energy (in joules/centimeter squared) shown in Table IV. Under predetermined conditions of laser scanning, as the specific surface energy increases the maximum temperature seen by the tube surface and the maximum depth of the first layer of Widmanstätten structure, both increase. Rough estimates of the maximum surface temperature reached by the tube were made with an optical pyrometer and are also shown in Table IV. While these values are only rough estimates they can be used to compare one set of runs to another and they complement the calculated specific surface energy values since the latter are known to be effected by interference of the chamber atmospheric conditions on laser workpiece energy coupling.

The tubes treated included conventionally processed cold pilgered Zircaloy-2 and Zircaloy-4 tubes having a 0.65 inch diameter×0.07 inch wall thickness, and a 0.7 inch diameter×0.07 inch wall thickness, respectively. The tubes had a mill pickled surface. Ingot chemistries of the material used for the various runs are shown in Table V.

After the beta treatment the tubes were cold pilgered in one step and processed (e.g. centerless ground and pickled) to final size, 0.484 inch diameter×0.0328 inch wall thickness, and 0.374 inch diameter×0.023 inch wall thickness for the Zircaloy-2 and Zircaloy-4 heats, respectively.

Representative sections from various runs were then evaluated for microstructure, corrosion properties, and hydriding properties. Microstructural evaluation indicated that for the runs shown in Table IV the Widmanstätten structure originally produced in the 0.070 inch wall typically extended inwardly from the surface to a depth of from 10 to 35 percent of the wall thickness, depending upon the beta treatment temperature. The absolute value of these first layer depths, of course, decreased significantly due to the reduction in wall thickness caused by the final cold pilgering.

Lengths of tubing from the various runs were then pickled and corrosion tested in high temperature, high pressure steam and the data are as shown in Tables VI and VII. It will be noted that in all cases the samples processed in accordance with this invention had significantly lower weight gains than the conventionally alpha worked material included in the test standards. It was noted, however, that in some cases varying degrees of accelerated corrosion were observed on the laser beta treated and cold worked samples (see Table VI 1120° C., and 1270°–1320° C. materials). These are believed to be an artifact of the experimental tube handling system used to move the tube under the laser beam which allowed some portions of tubes to vibrate excessively while being laser treated. These vibrations are believed to have caused portions of the tube to be improperly beta treated resulting in a high variability in the thickness of the beta treated layer around the tube circumference in the affected tube sections, causing the observed localized areas of high corrosion. It is therefore believed that these incidents of accelerated corrosion are not inherent products of the present invention, which typically produces excellent corrosion resistance.

Oxide film thickness measurements performed on the corrosion-tested laser-treated and cold-worked Zircaloy-4 samples from the tests represented in Table VI surprisingly indicated that the inside diameter surface, as well as the outside diameter surface, both had equivalent corrosion rates. This was true for all the treatments represented in Table VI except for the 1120° C. treatment, where the inner wall surface had a thicker oxide film than the outer wall surface.

Based on the preceding high temperature, high pressure steam corrosion tests it is believed that these alpha having a Widmanstätten microstructure adjacent and beneath one surface, and an inner layer, beneath the outer layer, having recrystallized grain structure with the fine precipitate size of the copending application. Subsequent working and annealing in accordance with the present invention would produce a final product having a substantially random precipitate distribution and a fine precipitate size in its inner layer.

In applying the present process to Zirconium-niobium alloys it is preferred that the material be aged at 400°-600° C. after cold working. This aging will occur during intermediate and final anneals performed on the material after the laser surface treatment.

The above examples of this invention are only illustrative of the many possible products and processes coming within the scope of the attached claims.

TABLE I

LASER PROCESSING PARAMETERS FOR HEAT TREATMENT OF FINISHED DIMENSION ZIRCALOY TUBING

| Condition No. | Tube Dimensions (dia/wall) | Beam Configuration (Line Source)* | Laser Power (on work) | Tube Rotation RPM/IPM** | Tube Withdrawal IPM | Power Density KW/cm$^2$ | Calculated incident Specific Surface Energy J/cm$^2$ |
|---|---|---|---|---|---|---|---|
| 1 | 0.375"/0.022" | 0.2" × 0.4" | 5 KW | 485/590 | 146 | 9.7 | 197 |
| 2 | 0.375"/0.022" | 0.2" × 0.4" | 5 KW | 473/574 | 142 | 9.7 | 202 |
| 3 | 0.375"/0.022" | 0.2" × 0.4" | 5 KW | 455/552 | 137 | 9.7 | 210 |
| 4 | 0.375"/0.022" | 0.2" × 0.4" | 5 KW | 430/521 | 129 | 9.7 | 223 |
| 5 | 0.375"/0.022" | 0.2" × 0.4" | 5 KW | 407/494 | 122 | 9.7 | 235 |
| 6 | 0.375"/0.022" | 0.2" × 0.4" | 5 KW | 376/456 | 113 | 9.7 | 254 |
| 7 | 0.375"/0.022" | 0.2" × 0.4" | 5 KW | 332/403 | 100 | 9.7 | 288 |
| 8 | 0.375"/0.022" | 0.2" × 0.4" | 5 KW | 285/345 | 86 | 9.7 | 336 |
| 9 | 0.375"/0.022" | 0.2" × 0.4" | 5 KW | 241/293 | 72 | 9.7 | 398 |
| 10 | 0.375"/0.022" | 0.2" × 0.4" | 5 KW | 196/238 | 59 | 9.7 | 488 |
| 11 | 0.375"/0.022" | 0.2" × 0.4" | 5 KW | 147/178 | 44 | 9.7 | 651 |

*Major dimension of beam (0.4") aligned parallel to rotational axis of tube.
**IPM = inches per minute = vector sum of the rotational velocity and translational velocity (tube withdrawal IPM).

Zirconium alloys will also have improved corrosion resistance in PWR and BWR environments.

The mechanical property characteristics and hydriding characteristics of the treated materials were found to be acceptable.

In this invention since only a surface layer of the intermediate tube is beta treated, it is believed that the crystallographic texture of the final product can be more easily tailored to provide desired final properties compared to the method disclosed in U.S. Pat. No. 3,865,635. In this invention both the alpha working before and after the surface beta treatment can be used to form the desired texture in the inner layer of the tube.

Both good outside diameter and inside diameter corrosion properties have been achieved by laser surface treating and cold working according to this invention, without resort to the precipitate size control steps of copending application Ser. No. 343,787, (filed on Jan. 29, 1982 and assigned to Westinghouse Electric Corporation) prior to the laser treating step, as demonstrated by the preceding examples. However, in another embodiment of the present invention, the process of the copending application, utilizing reduced extrusion and intermediate annealing temperature, may be practiced in conjunction with the high energy beam beta treatments of this invention. In this embodiment, the high energy beam surface treatment would be substituted for the intermediate anneal at step 5, 7 or 9, of the copending application. The intermediate product, in the surface beta treated condition, would have an outer layer

TABLE II

ZIRCALOY-4 LASER HEAT TREATMENTS

| Rotation Rate (rpm) | Translation Rate (in/min) | Optical Microstructural Observations | Microhardness (kg/mm$^2$) |
|---|---|---|---|
| 485 | 145.5 | No Observable Effect | 219 |
| 473 | 142 | " | 228 |
| 455 | 136.5 | " | 215 |
| 430 | 129 | " | 228 |
| 407 | 122 | " | 222 |
| 376 | 113 | " | 224 |
| 332 | 100 | " | 223 |
| 285 | 85.5 | " | 207 |
| 241 | 72 | Fine Recrysrallized Structure | 222 |
| 196 | 59 | Widmanstätten Structure | 196 |
| 147 | 44 | Widmanstätten Structure | 196 |

TABLE III

454° C. (850° F.) CORROSION DATA OBTAINED ON LASER TREATED ZIRCALOY-4 TUBING EXPOSED FOR 30 DAYS

| Sample | Mean Weight Gain (mg/dm$^2$) |
|---|---|
| 285 rpm | 168 |
| 241 rpm | 217 |
| 196 rpm | 207 |
| 147 rpm | 211 |
| Beta-Annealed (950° C.) + Water Quenched | 262 |

TABLE IV

LASER PROCESSING PARAMETERS FOR HEAT TREATMENT OF INTERMEDIATE DIMENSION ZIRCALOY TUBING

| Run No. | Tube Dimensions (dia/wall) | Beam Configuration (ring) | Laser Power (on work) | Tube Rotation RPM | Tube Withdrawal IPM | Power Density KW/cm² | Calculated Incident Specific Surface Energy J/cm² | Estimated Maximum Surface Temp. |
|---|---|---|---|---|---|---|---|---|
| | (Zr-4) | | | | | | | |
| 23 | 0.700/0.070 | 0.7" × 0.1" | 12 KW | ~1500 | 20 | 8.5 | 2550 | |
| 24 | " | " | " | " | " | " | " | |
| 25 | " | " | " | " | " | " | " | |
| 26 | " | " | " | " | " | " | " | ~1210° C. |
| 27 | " | " | " | " | " | " | " | |
| 28 | " | " | " | " | " | " | " | |
| 29 | 0.700/0.070 | 0.7" × 0.1" | 12 KW | ~1500 | 24 | 8.5 | 2125 | |
| 30 | " | " | " | " | " | " | " | |
| 31 | " | " | " | " | " | " | " | ~1150° C. |
| 32 | " | " | " | " | " | " | " | |
| 33 | " | " | " | " | " | " | " | |
| 34 | 0.700/0.070 | 0.7" × 0.1" | 12 KW | ~1500 | 28 | 8.5 | 1820 | |
| 35 | " | " | " | " | " | " | " | ~1120° C. |
| 36 | " | " | " | " | " | " | " | |
| 37 | " | " | " | " | " | " | " | |
| 41 | " | " | " | " | 29 | " | 1759 | |
| 45 | " | " | " | " | 29 | " | 1759 | ~1270–1320° C. |
| 46 | " | " | " | " | 31 | " | 1645 | |
| 42 | 0.700/0.070 | 0.7" × 0.1" | 12 KW | ~1500 | 32 | 8.5 | 1594 | |
| 47 | " | " | " | " | 31 | " | 1645 | ~1230° C. |
| 48 | " | " | " | " | 33 | " | 1545 | |
| | (Zr-2) | | | | | | | |
| 49 | 0.650/0.070 | 0.65" × 0.1" | 12 KW | ~1500 | 33 | 9.1 | 1654 | |
| 50 | " | " | " | " | " | " | " | ~1160–1175° C. |
| 51 | " | " | " | " | " | " | " | |
| 52 | 0.650/0.070 | 0.65" × 0.1" | 12 KW | ~1500 | 28 | 9.1 | 1950 | |
| 53 | " | " | " | " | " | " | " | ~1300–1320° C. |
| 54 | " | " | " | " | " | " | " | |
| 55 | 0.650/0.070 | 0.65" × 0.1" | 12 KW | ~1500 | 30 | 9.1 | 1820 | |
| 56 | " | " | " | " | " | " | " | ~1210–1275° C. |
| 57 | " | " | " | " | " | " | " | |
| 58 | " | " | " | " | " | " | " | |
| 59 | 0.650/0.070 | 0.65" × 0.1" | 12 KW | ~1500 | 34 | 9.1 | 1605 | |
| 60 | " | " | " | " | " | " | " | ~1175–1185° C. |
| 61 | " | " | " | " | " | " | " | |
| 62 | 0.650/0.070 | 0.65" × 0.1" | 12 KW | ~1500 | 36 | 9.1 | 1517 | ~1170° C. |
| 63 | " | " | " | " | " | " | " | |

TABLE V

INGOT CHEMISTRY OF ZIRCALOY TUBES PROCESSED IN ACCORDANCE WITH THE INVENTION

| | Zircaloy-4 Heat A Run Nos. 23–43 | Zircoloy-4 Heat B Run Nos. 44–48 | Zircaloy-2 Run Nos. 49–63 |
|---|---|---|---|
| Sn | 1.46–1.47 w/o | 1.42–1.52 w/o | 1.44–1.63 w/o |
| Fe | .22–.23 w/o | .19–.23 w/o | .14–.16 w/o |
| Cr | .11–.12 w/o | .10–.12 w/o | .11 –.12 w/o |
| Ni | <50 ppm | <35 ppm | .05–.06 w/o |
| Al | 42–46 ppm | 39–58 ppm | <35 ppm |
| B | <0.5 ppm | <0.25 ppm | <0.2 ppm |
| Ca | NR | <15 ppm | NR |
| Cd | <0.5 ppm | <0.25 ppm | <0.2 ppm |
| C | 115–127 ppm | 125–165 ppm | 10–40 ppm |
| Cl | <10 ppm | 7–11 ppm | <10 ppm |
| Co | <10–13 ppm | <10 ppm | <10 ppm |
| Cu | <10 ppm | <25–44 ppm | <25 ppm |
| Hf | 52–53 ppm | <80–84 ppm | 51–57 ppm |
| Mn | <10 ppm | <25 ppm | <25 ppm |
| Mg | <10 ppm | <10 ppm | <10 ppm |
| Mo | <20 ppm | <25 ppm | <25 ppm |
| Pb | NR | <25 ppm | NR |

TABLE V-continued

INGOT CHEMISTRY OF ZIRCALOY TUBES PROCESSED IN ACCORDANCE WITH THE INVENTION

| | Zircaloy-4 Heat A Run Nos. 23–43 | Zircoloy-4 Heat B Run Nos. 44–48 | Zircaloy-2 Run Nos. 49–63 |
|---|---|---|---|
| Si | 52–54 ppm | 60–85 ppm | 99–119 ppm |
| Nb | <50 ppm | <50 ppm | NR |
| Ta | 100 ppm | <100 ppm | NR |
| Ti | 18–48 ppm | <25 ppm | <25 ppm |
| U | <0.5 ppm | <1.8 ppm | <1.8 ppm |
| U235 | .002–.004 ppm | .010 ppm | NR |
| V | <20 ppm | <25 ppm | NR |
| W | <50 ppm | <50 ppm | <50 ppm |
| Zn | <50 ppm | NR | NR |
| H | 2–18 (12–17) ppm | 5–7 ppm | (<12) ppm |
| N | 35–40 (35–43) ppm | 40 ppm | (21–23) ppm |
| O | 1100–1140 (1100–1200) ppm | 1200–1400 ppm | (1350–1440) ppm |

Values reported typically represent the range of analyses determined from various positions on the ingot.
Values in parentheses represent the range of analyses as determined on TREX.
NR = not reported

TABLE VI

AS PILGERED ZIRCALOY-4 TUBING
850° F. 1500 PSI, 20 DAY EXPOSURE
CORROSION TEST RESULTS

| Run Nos. | Estimated Approximate Maximum Surface Temp. | Weight Gain ($mg/dm^2$) $\bar{X}$* | S* | Remarks |
|---|---|---|---|---|
| 34, 35, 36, 37 | 1120° C. | 230.2 | 12.5 | Accelerated corrosion occurred on 8 of 12 coupons |
| 29, 30, 31, 32, 33 | 1152° C. | 86.3 | 4.8 | Adherent black continous oxide on OD and ID |
| 23, 24, 25, 26, 27, 28 | 1210° C. | 95.8 | 9.6 | Adherent black continous oxide on OD and ID |
| 42, 47, 48 | 1230° C. | 105.6 | 10.4 | Adherent black continous oxide on OD and ID |
| 41, 45, 46 | 1270–1320° C. | 83.4 | 6.9 | Adherent black continous oxide on OD and ID |
| | | 285.0 | 79.0 | White oxide on portions of samples, but not spalling |
| Zircaloy-4 Standards | | 445.2 | 48 | Exposure terminated at 10 days due to white spalling oxide |

*$\bar{X}$ = mean weight gain
*S = estimated standard deviation

TABLE VII

AS PILGERED ZIRCALOY-2 TUBING
935° F., 1500 PSI 24 HOUR EXPOSURE
CORROSION TEST RESULTS

| Estimated Approximate Maximum Surface Temp. | Weight Gain ($mg/dm^2$) $\bar{X}$ | S | Remarks |
|---|---|---|---|
| 1170–1185° C. | 52.9 | 14.7 | Adherent black continous oxide on OD and ID |
| 1210–1275° C. | 50.6 | 2.9 | Adherent black continous oxide on OD and ID |
| 1300–1320° C. | 65.6 | 5.4 | Adherent black continous oxide on OD and ID |
| Zircaloy-2 standards | 261.4 | 51.9 | White spalling oxide at edges of coupons |

We claim:

1. A process for improving the high temperature steam corrosion resistance of an alpha zirconium alloy body having a random precipitate distribution comprising the steps of:

beta treating a first layer of said body, wherein said first layer is beneath and adjacent to a first surface of said body, and wherein said beta treating produces two dimensional linear arrays of precipitates in said first layer;

while forming a second layer of alpha recrystallized grains beneath said first layer while maintaining said random precipitate distribution in said second layer;

then cold working said body;

then final annealing said body;

and wherein after said final anneal both said first layer and said second layer have said improved high temperature steam corrosion resistance as evidenced by an adherent substantially black continuous oxide film formed on both said first layer and said second layer upon 24 hours exposure of said first layer and said second layer to a 500° C., 1500 psi steam test.

2. The process according to claim 1 wherein said cold working step comprises two or more cold working steps separated by an intermediate annealing step.

3. The process according to claim 1 wherein said cold working step comprises cold working said body to a degree sufficient to redistribute said two dimensional arrays of precipitates in a substantially random manner.

4. The process according to claim 1 wherein said beta treating step is performed by directing a high energy beam on to said first surface.

5. The process according to claim 4 wherein said high energy beam is a laser beam.

6. The process according to claim 1 wherein during said beta treating step the temperature of said first layer of said body is above the alpha+beta to beta transus temperature for only a fraction of a second.

7. The process according to claim 2 wherein said cold working, and said annealing are performed at a temperature below approximately 600° C.

8. The process according to claim 1 wherein said alpha zirconium alloy is selected from the group consisting of Zircaloy-2, Zircaloy-4 and zirconium-niobium alloys.

9. The process according to claim 3 wherein said alpha zirconium alloy is selected from the group consisting of Zircaloy-2 and Zircaloy-4.

10. An alpha zirconium alloy final size component produced in accordance with claim 1 and comprised of Zircaloy.

11. An alpha zirconium alloy final size component in accordance with claim 10 wherein said component is a thin walled tubular fuel cladding.

12. A process for increasing the corrosion resistance of a surface of an alpha zirconium alloy body in a cold worked condition and having a substantially random precipitate distribution throughout said body, comprising the steps of:

rapidly scanning said surface of said body with a means for rapidly heating said body;

controlling said scanning and said means for rapidly heating said body to heat said surface to a temperature high enough to produce a partially recrystallized microstructural region adjacent said surface, but low enough to retain said substantially random precipitate distribution in said partially recrystallized microstructural region; wherein the corrosion resistance of said surface is increased to a level wherein said surface is characterized by a black oxide film after 5 days exposure to 454° C., 1500 psi steam.

13. A process for increasing the corrosion resistance of a surface of an alpha zirconium alloy body in a cold worked condition and having a substantially random precipitate distribution throughout said body, comprising the steps of:

rapidly scanning said surface of said body with a means for rapidly heating said body;

controlling said scanning and said means for rapidly heating said body to heat said surface to a temperature high enough to produce a fully recrystallized equiaxed alpha microstructural region adjacent to said surface, but low enough to retain said substantially random precipitate distribution in said fully recrystallized microstructural region; wherein the corrosion resistance of said surface is increased to a level wherein said surface is characterized by a black oxide film after 5 days exposure to 454° C., 1500 psi steam.

14. The process according to claim 1 wherein said improved high temperature steam corrosion resistance is further characterized by an average weight gain of less than about 71 mg/dm$^2$ upon said 24 hours exposure to said 500° C., 1500 psi steam test.

15. The process according to claim 12 wherein said alpha zirconium alloy is selected from the group consisting of Zircaloy-2 and Zircaloy-4.

16. The process according to claim 13 wherein said alpha zirconium alloy is selected from the group consisting of Zircaloy-2 and Zircaloy-4.

17. The process according to claim 12 followed by the additional steps comprising cold working and annealing said body while retaining the corrosion resistance imparted to said body by said rapid scanning.

18. The process according to claim 13 followed by the additional steps comprising cold working and annealing said body while retaining the corrosion resistance imparted to said body by said rapid scanning.

19. The process according to claim 17 wherein said alpha zirconium alloy is selected from the group consisting of Zircaloy-2 and Zircaloy-4.

20. The process according to claim 18 wherein said alpha zirconium alloy is selected from the group consisting of Zircaloy-2 and Zircaloy-4.

* * * * *